United States Patent [19]

Heitmann et al.

[11] Patent Number: 4,869,273

[45] Date of Patent: Sep. 26, 1989

[54] METHOD AND APPARATUS FOR BUILDING A CONTINUOUS STREAM OF TOBACCO OR THE LIKE

[75] Inventors: Uwe Heitmann; Peter Brand, both of Hamburg, Fed. Rep. of Germany

[73] Assignee: Körber AG, Hamburg, Fed. Rep. of Germany

[21] Appl. No.: 891,540

[22] Filed: Jul. 31, 1986

[30] Foreign Application Priority Data

Aug. 8, 1985 [DE] Fed. Rep. of Germany ..... 3528455

[51] Int. Cl.[4] ..... A24C 5/14

[52] U.S. Cl. ..... 131/84.3; 131/109.1; 131/84.1

[58] Field of Search ..... 131/84.3, 109.1, 84.1

[56] References Cited

U.S. PATENT DOCUMENTS

| | | | |
|---|---|---|---|
| 3,045,681 | 7/1962 | Richter | 131/84.1 |
| 4,003,385 | 1/1977 | Adebahr | 131/84.3 |
| 4,373,538 | 2/1983 | Steiniger | 131/109.1 |

FOREIGN PATENT DOCUMENTS 0976145 11/1964 United Kingdom .

*Primary Examiner*—V. Millin

*Attorney, Agent, or Firm*—Peter K. Kontler

[57] ABSTRACT

A cigarette rod making machine wherein the distributor forms a continuous stream of tobacco particles including freshly admitted tobacco particles and surplus which is removed from the stream by a trimming device. Fresh tobacco particles are drawn from a duct and are converted into a shower which is classified prior to admission of the surplus. The surplus is admitted across the full width of the shower of fresh tobacco in such quantities that the combined mass of the surplus and fresh tobacco in the trimmed stream is substantially constant. This is achieved by monitoring the quantity of surplus which is removed from the stream and regulating the rate of admission of fresh tobacco in accordance with the characteristics of signals denoting the monitored quantities of the surplus.

25 Claims, 3 Drawing Sheets

METHOD AND APPARATUS FOR BUILDING A CONTINUOUS STREAM OF TOBACCO OR THE LIKE

BACKGROUND OF THE INVENTION

The invention relates to a method of and to an apparatus for building a continuous stream of fibrous material, such as fragments of tobacco leaves, filter material for the making of filter mouthpieces, artificial tobacco, reconstituted tobacco and the like. More particularly, the invention relates to improvements in a method of and in an apparatus for making a stream which contains a surplus or excess of fibrous material and from which the surplus must be removed in order to leave a rod-like filler which is ready to be draped into a web of cigarette paper, artificial cork or other suitable wrapping material.

The following description will deal with the making of a stream of tobacco in a cigarette rod making machine with the understanding, however, that the same method and the same apparatus can be used with equal or with similar advantage for the making of a stream which can be converted into a cigarillo rod, a cigar rod or a filter rod.

The making of cigarettes involves withdrawal of comminuted tobacco leaves from a source of supply in a distributor (also called hopper) and conversion of the withdrawn tobacco into a continuous stream which contains a surplus. The surplus is removed by a so-called trimming or equalizing device which severs the fibers projecting beyond a predetermined (trimming) plane so that the trimmed or equalized stream constitutes a rod-like filler which is ready for draping into cigarette paper or the like. The surplus must be reused since tobacco constitutes the most expensive constituent of cigarettes. As a rule, or in many instances, tobacco particles which are withdrawn from the source of supply are converted into a shower whose particles are caused to deposit at one side of an endless foraminous belt conveyor to form a continuous stream which advances past the cutter or cutters of the means for removing the surplus. It is also customary to singularize or loosen the particles of tobacco which are withdrawn from the source of supply in order to facilitate the making of a continuous stream wherein each successive increment contains the same or substantially the same quantity of fibrous material. The shower can be formed mechanically or pneumatically, and the shower can be advanced toward the respective side of the belt conveyor by mechanical and/or pneumatic means. The surplus which is removed at the trimming station can be returned into the distributor and admitted to fresh tobacco particles in a number of different ways.

For example, the returned surplus can be admitted into the supply of fresh tobacco particles so that it is caused to pass again through the withdrawing unit and to undergo a singularizing or loosening treatment. Such singularizing or loosening treatment invariably or nearly invariably involves at least some undesirable comminution of tobacco shreds.

In accordance with another prior proposal which is discussed, for example, in U.S. Pat. Nos. 3,244,184 and 3,045,681, surplus tobacco is admitted to one side of the shower of fresh tobacco which is on its way toward the admitted surplus tobacco occupies a predetermined portion of the trimmed stream (filler).

British Pat. No. 976,145 discloses means for delivering surplus tobacco into a predetermined region of the stream building conveyor. The proposal which is discussed in the British patent and the proposals which are discussed in the aforementioned U.S. patents exhibit the drawback that the surplus is not uniformly distributed in the filler downstream of the trimming station.

U.S. Pat. No. 3,732,871 discloses a distributor which is provided with means for accumulating so-called tobacco shorts at a predetermined location and for admitting shorts into the shower of fresh tobacco in such a way that the shorts accumulate in a predetermined portion of the tobacco filler. This proposal exhibits the same drawbacks as the proposals in the previously discussed patents.

OBJECTS AND SUMMARY OF THE INVENTION

An object of the invention is to provide a novel and improved method of reusing the surplus which is removed from a continuous stream of fibrous material of the tobacco processing industry.

Another object of the invention is to provide a method which ensures predictable and optimum distribution of recirculated fibrous material in the stream which is about to be converted into a rod-like filler.

A further object of the invention is to provide a method which ensures that the surplus of fibrous material need not undergo any, or undergoes a minimum of, treatment which would be likely to reduce the size of particulate material of the surplus.

An additional object of the invention is to provide a method of making a continuous rod-like filler of tobacco, filter material or the like.

Still another object of the invention is to provide a method of recirculating surplus tobacco from the trimming station to the stream building station of a cigarette rod making, filter rod making or another machine of the tobacco processing industry.

A further object of the invention is to provide a novel and improved apparatus which can be incorporated into a cigarette rod making machine, a filter rod making machine or an analogous rod-making machine of the tobacco processing industry for rapid, predictable, economical and gentle treatment of surplus fibrous material.

Another object of the invention is to provide a rod making machine which embodies the above outlined apparatus.

Still another object of the invention is to provide a novel and improved apparatus which can be installed in existing rod making machines as a superior substitute for existing rod making apparatus.

Another object of the invention is to provide an apparatus wherein the removed surplus of fibrous material is uniformly distributed in loosened fibrous material which is on its way from the distributor or hopper to the stream building or forming station.

Another object of the invention is to provide a rod-like filler wherein fresh fibrous material and surplus fibrous material are distributed in a novel and improved way.

A further object of the invention is to provide a novel and improved surplus recirculating unit for use in a cigarette rod making or filter rod making machine.

One feature of the present invention resides in the provision of a method of building a stream of particulate fibrous material, such as fragments of tobacco leaves.

The method comprises the steps of converting a continuous flow of fibrous material into a shower of at least partially singularized particles and admitting the shower into a first portion of a predetermined path so as to build a continuous stream which contains a surplus of fibrous material; advancing the stream along the predetermined path and equalizing the stream in a second portion of the path downstream of the first portion, including removing the surplus; monitoring the mass of the removed surplus and generating signals which denote the monitored mass; admitting the removed surplus directly into the flow of fibrous material which forms the shower; and utilizing the signals to regulate the quantity of fibrous material in the flow so as to maintain the combined quantity of fibrous material of the flow and of the surplus downstream of the second portion of the path at an at least substantially constant value.

The converting step preferably includes forming a relatively wide shower of fibrous material, and the admitting step preferably includes introducing the surplus into the shower along the major part at least, or along the full width, of the shower.

The method can further comprise the step of at least partially singularizing the fibrous material of the surplus not later than in the course of the admitting step.

The method can further comprise the steps of establishing and maintaining a source of fibrous material, drawing from the source a continuous layer or fleece of fibrous material with the carding of a rotary conveyor, expelling successive increments of the layer from the carding by a rapidly driven picker roller and transforming the expelled increments into a current, and loosening the fibrous material of the current so as to convert the current into the aforementioned flow. The loosening step can include accelerating the particles of fibrous material in the current by a rapidly driven rotary conveyor. The transforming step preferably includes advancing the expelled increments with the carding of a second rotary conveyor at a speed which is preferably several times the speed of the aforementioned layer. Such method can further comprise the step of classifying the particles of the flow according to size, including conveying a stream of gaseous fluid transversely of and across the flow so as to divert lighter particles toward the first portion of the path. The diverting step preferably includes guiding the lighter particles along a predetermined second path.

The method can further comprise the step of storing the removed surplus of fibrous material. The admitting step then includes transferring metered quantities of fibrous material from the stored surplus into the aforementioned flow. The storing step can include accumulating the surplus in a funnel-shaped magazine, and the transferring step preferably includes removing surplus from the magazine by means of an elevator conveyor.

Another feature of the invention resides in the provision of an apparatus for building a stream of particulate fibrous material, such as fragments of tobacco leaves. The apparatus comprises a source of supply of fibrous material; an elongated stream forming conveyor which defines an elongated path; an adjustable feeding device having means for continuously drawing a flow of fibrous material from the source of supply, for converting the flow into a shower, and for admitting the shower into a first portion of the path so that the conveyor accumulates and advances, in a predetermined direction, a continuous stream containing a surplus of fibrous material; a trimming device which is provided with means for removing the surplus from the stream in a second portion of the path downstream of the first portion; means for admitting the removed surplus to the fibrous material in the feeding device; means for monitoring the mass of the removed surplus and for generating signals which denote the monitored mass; and means for adjusting the feeding device in response to the signals so that the combined quantity of surplus and fibrous material from the source of supply in the stream downstream of the trimming device is at least substantially constant. The feeding device can be provided with means for converting the flow into a shower having a predetermined width, and the admitting means preferably includes means for delivering the fibrous material of the surplus to the shower along the major portion at least of the predetermined width of the shower. The admitting means can comprise a vibratory conveyor. Such vibratory conveyor is preferably formed with a discharge end which extends at an oblique angle to the direction of advancement of fibrous material along the vibratory conveyor. The admitting means preferably further comprises means for showering the surplus intermediate the vibratory conveyor and the shower which is formed by the feeding device. The discharge end of the vibratory conveyor is preferably disposed above the showering means, and the showering means comprises or can comprise a rotary carded conveyor which is disposed below the discharge end of the vibratory conveyor to accumulate a layer of fibrous material, and a picker roller which serves to expel successive increments of the layer from the carding of the carded conveyor.

The drawing means preferably comprises a first rotary carded conveyor which serves to remove fibrous material from the source of supply in the form of a continuous first layer at a first speed, a first picker roller which serves to expel successive increments of the first layer from the carding of the carded conveyor at a higher second speed, a second rotary carded conveyor which serves to accumulate the expelled fibrous material into a second layer and to advance the second layer at a speed which is several times the first speed, and a second picker roller which serves to expel successive increments of the second layer from the carding of the second conveyor and to convert such increments into a shower of fibrous material. The source of supply preferably comprises a duct having a discharge end above the first carded conveyor. The speed of the second layer on the second carded conveyor is preferably between five and ten times the first speed. As a rule, the source of supply will be disposed at a level above the first carded conveyor, and the first carded conveyor will be disposed at a level above the second carded conveyor. This contributes to compactness of the improved apparatus.

The second stream contains lighter and heavier particles of fibrous material and the converting means comprises means for directing at least one current of air or another suitable gaseous fluid across the showered second layer so as to divert lighter particles of fibrous material toward the first portion of the path. The heavier particles traverse the current of air and entrain, or are likely to entrain, some of the lighter particles. Therefore, the apparatus preferably further comprises means for pneumatically segregating the entrained lighter particles and for delivering the segregated lighter particles to the flow of fibrous material not later than in the first portion of the path.

The admitting means can comprise a magazine for the removed surplus and means for supplying fibrous material from the magazine to the flow in the feeding device. The supplying means can include an elevator conveyor which serves to draw fibrous material from the magazine. The admitting means of such apparatus can comprise a conveyor which serves to admit into the magazine fibrous material constituting the so-called long ends (untrimmed particles which have advanced beyond the trimming station during the initial stage of the making of a filler rod).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
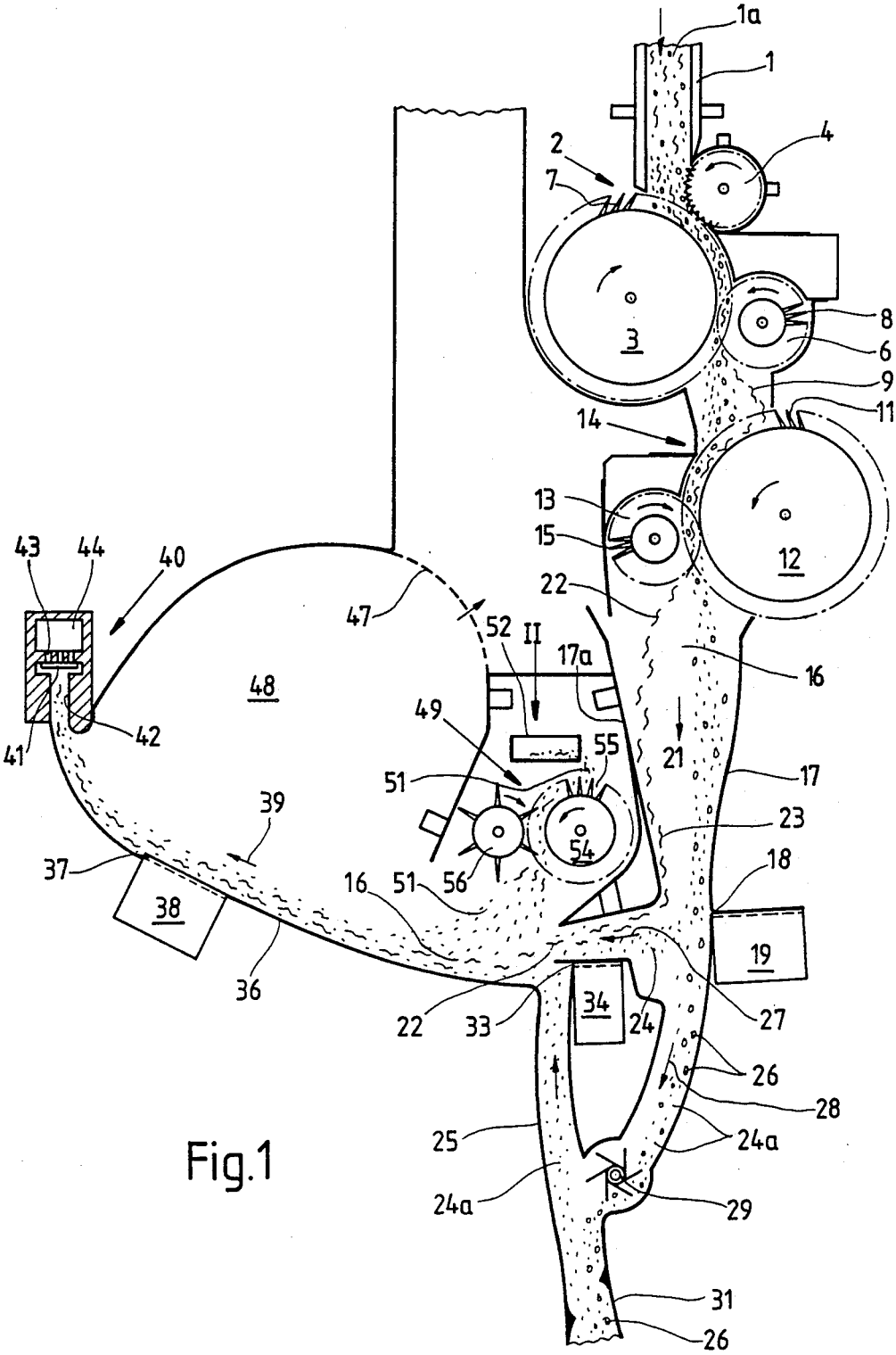
FIG. 1 is a schematic partly elevational and partly vertical sectional view of the distributor or hopper in an apparatus which embodies one form of the invention.

Referring to FIG. 1, there is shown a portion of an apparatus which is used to build up a continuous rod-shaped filler 69 (FIG. 3) from fibrous material which constitutes fragments of tobacco leaves, fragments of sheets of reconstituted tobacco or similar smokable material. The source of supply of fresh fibrous material is an upright duct 1 the lower end portion of which is adjacent a carded drum 3 constituting a conveyor means for continuously drawing a flow of fibrous material from the duct 1. The supply la of fibrous material in the duct 1 is maintained at a substantially constant level, e.g., in a manner as disclosed in commonly owned U.S. Pat. No. 4,373,538 to Steiniger. The disclosure of this patent is incorporated herein by reference. The carded drum 3 forms part of an adjustable feeding device 2 serving to advance a flow of fibrous material from the duct 1 to the underside of the lower reach of an elongated forminous stream forming or building conveyor 41 shown in the left-hand portion of FIG. 1 and also, in FIG. 3. FIG. 1 further shows an optional rotary metering conveyor 4 which is adjacent one side of the outlet or discharge end of the duct 1 and is located at the one o'clock position of the carded drum 3. The layer of fibrous material which is withdrawn from the duct 1 by the carding 7 of the drum 3 is expelled from the carding by the pins 8 of a rapidly driven picker roller 6 at the three or four o'clock position of the drum 3.

The current or shower 9 of fibrous material which is formed by the pins 8 of the picker roller 6 descends onto the carding 11 of a carded rotary drum-shaped conveyor 12 forming part of a singularizing or loosening unit 14. Such unit further comprises a rapidly rotating picker roller 13 having pins 15 which expel the layer of fibrous material from the carding 11. The speed at which the conveyor 12 is driven is preferably several times (for example, between five and ten times) the speed of the drum 3. Consequently, and if the diameters of the conveyor 12 and the drum 3 are the same or nearly the same, the thickness of the layer which is carried by the carding 11 toward the picker roller 13 is only a small fraction of the thickness of the layer in the carding 7 of the drum 3. In other words the fibers of the first layer are singularized first by the picker roller 6 and thereupon by the unit 14 which includes the conveyor 12 and the associated picker roller 13. The picker roller 13 forms a continuous shower 16 which contains smaller and larger, lighter and heavier particles of fibrous material descending in the direction of the arrow 21 in the interior of a funnel-shaped channel 17 which tapers downwardly and away from the unit 14.

The channel 17 contains a classifying device including one or more nozzles 18 connected to a source 19 of compressed air to discharge one or more streams of compressed air in the direction indicated by arrow 27, namely transversely of the direction of downward travel of the constituents of the shower 16.

The air stream or streams issuing from the nozzle or nozzles 18 segregate the lighter fibers 22 which consist of longer tobacco shreds and relatively short and lightweight tobacco shreds 24 from the heavier tobacco shreds 26 (primarily or exclusively fragments of tobacco ribs) and transports the shreds 22, 24 in a direction transversely of that indicated by the arrow 21. As can be seen in FIG. 1, the pins 15 of the picker roller 13 propel a stream 23 of longer shreds 22 against a sidewall 17*a* of the channel 17 which leads to the passage for the segregated shreds 22, 24. Such mounting of the wall 17*a* is desirable and advantageous because the longer shreds 22 are less likely to be intertwined with the heavier particles 26 and to be entrained beyond the passage for segregated shreds including those denoted by the reference characters 22 and 23. Moreover, such positioning of the wall 17*a* ensures that the longer shreds 22 are not mixed with shorter shreds 24 which could undesirably influence the classifying operating because some or a substantial percentage of fragments would not be capable of undergoing classification according to their specific weight.

Some of the lighter particles (denoted by the character 24*a*) descend with the heavier particles 26 in the direction of the arrow 28 (i.e., such lighter particles traverse the stream or streams of air flowing in the direction of the arrow 27). The lightweight particles 24*a* are evacuated from the channel 17 by a cell wheel 29 and enter a further channel or duct 31 wherein the heavier particles 26 descend to a collecting receptacle, not shown. The lighter particles 24*a* are caused to rise in a channel 25 and to be admixed to the shower of lightweight particles at the right-hand end of a suitably configurated guide wall 36 leading toward the stream building station 40 of the conveyor 41. The particles 24*a* rise in the channel 25 under the injector action of one or more streams of compressed air which issue from one or more nozzles 33 connected with a source 34 of compressed air.

The mixture of fragments or particles 23, 24 and 24a advances along the suitably configurated upper side of the guide wall 36 in the direction of the arrow 39 and into the range of one or more streams of compressed air issuing from one or more nozzles 37 connected to a source 38 of compressed air. The nozzles 37 can be said to constitute a means for admitting the shower 16 into the first portion of an elongated substantially horizontal path which is defined by the lower reach of the stream building conveyor 41. The lower reach of the conveyor 41 travels in the uppermost portion of an elongated tobacco channel 42 at the stream building station 40. Such lower reach is adjacent the underside of a perforated wall 43 below a stationary suction chamber 44 having an outlet connected to a suction generating device 46 (see FIG. 3). The surplus of compressed air which is admitted by the nozzles 18, 33 and 37 is accumulated in an expansion chamber 48 and is discharged through a screen 47.

Figure 3:
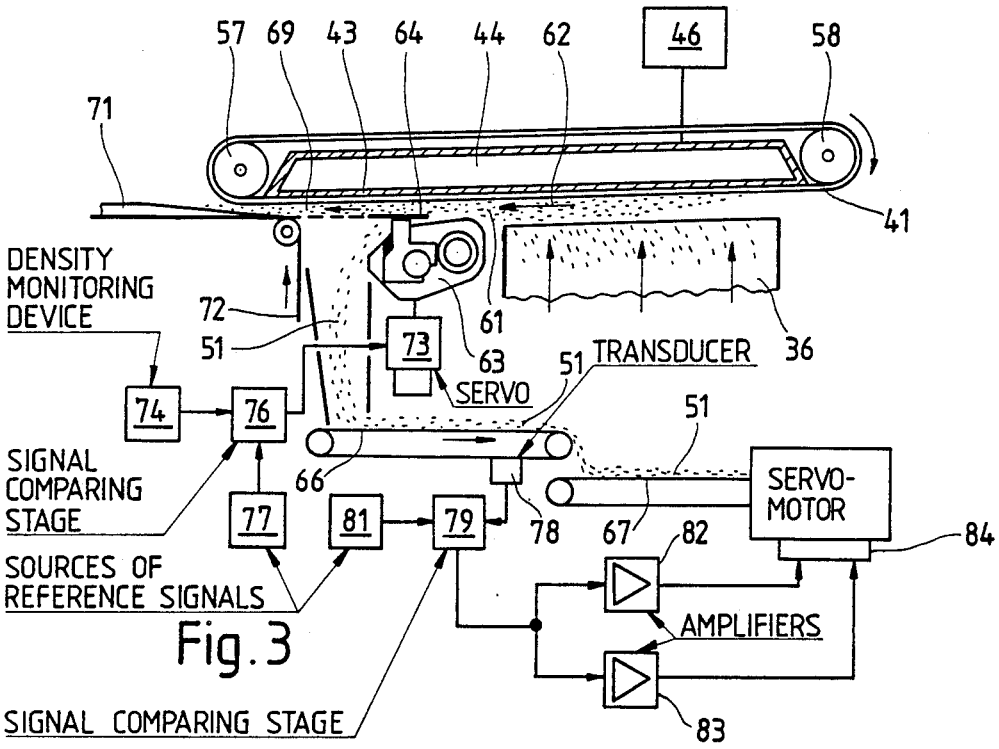
FIG. 3 is a schematic partly elevational and partly vertical sectional view of the stream building conveyor, of the trimming device, and of the means for collecting and transporting the surplus to the shower of fibrous material.

FIG. 3 shows that the foraminous stream building conveyor 41 is trained over pulleys 57, 58 one of which is driven so that the lower reach of the conveyor 41 advances in the direction of arrow 62. The stream building station 40 is located at a level above the upper end of the guide wall 36 shown in FIG. 3. The fully grown stream 61 contains a surplus (51) of fibrous material and advances into the range of an adjustable trimming device 63 having one or more rotary equalizing or trimming elements 64 disposed at a variable distance from the underside of the lower reach of the conveyor 41. The purpose of the element or elements 64 is to remove the surplus 51 whereby such surplus descends onto the upper stretch or reach of a belt weigher 66 forming part of a means for monitoring the mass per unit length of the surplus 51.

The means for delivering the surplus 51 to the shower 16 above the guide wall 36 is denoted by the reference character 49 (see FIG. 1). Such delivering means comprises a trough-shaped vibratory conveyor 52 which receives the surplus from a belt conveyor 67 shown in FIG. 3 and has a discharge end 53 (see FIG. 2) which extends at an oblique angle to the travel of the particles of the surplus 51 along the bottom wall of the vibratory conveyor 52. The receiving end of the vibratory conveyor 52 is located at a level below the discharge end of the belt conveyor 67 for surplus tobacco 51. The fragments which advance beyond the discharge end 53 of the conveyor 52 descend onto the carding 55 of a rotary drum 54 cooperating with a rapidly rotating picker roller 56 to singularize or loosen the eventually interlaced particles of the surplus 51 and to form a further shower which is admixed to the shower 16 containing the fragments or particles 23, 24 and 24a at the right-hand end of the guide wall 36 shown in FIG. 1.

If desired or necessary, the so-called tobacco shorts can be admitted to the shower 16 at or close to the location of admission of the surplus 51 at the level below the carded drum 54 and picker roller 56.

FIG. 3 shows that the rod-like filler 69 which is formed as a result of removal of the surplus 51 from the tobacco stream 61 advances onto the upper reach of the garniture tape forming part of a wrapping mechanism (also known as sizing part) wherein the filler 69 is draped into a web 72 of cigarette paper 72. The resulting cigarette rod (not shown) is subdivided into plain cigarettes of unit length or multiple unit length, and the cigarettes are transported to storage, to a packing machine or to a filter tipping machine, not shown.

The distance between the trimming element or elements 64 and the lower reach of the stream building conveyor 41 is adjustable by a servomotor 73 as a function of fluctuations of the mass flow of fibrous material in the cigarette rod. The density or mass of the filler in the cigarette rod is monitored by a density measuring device 74, for example, a device employing a source of corpuscular (e.g., beta) radiation and an ionization chamber of conventional design. The output of the density monitoring device 74 transmits signals to the corresponding input of a signal comparing stage 76 another input of which receives signals from a source 77 of reference signals. Such signals denote the desired or optimum density of the filler in the cigarette rod. The output of the signal comparing stage 76 transmits signals to the servomotor 73 for the trimming device 63 to change the level of the trimming element or elements 64 as dictated by fluctuations of the density of the filler in the cigarette rod. This ensures that the mass flow in the filler of the cigarette rod remains at least substantially constant.

The mass of the removed surplus 51 is monitored by the belt weigher 67 which cooperates with a transducer 78 serving to generate signals denoting the mass per unit length of the stream of surplus 51 which flows toward the upper reach of the belt conveyor 67. The output of the transducer 78 transmits electric signals to the corresponding input of a signal comparing stage 79. Another input of the stage 79 receives reference signals from a source 81 of reference signals. The output of the stage 79 transmits signals (depending upon the polarity of such signals) to one of two amplifiers 82, 83 whose outputs are connected to an adjusting device 84 which can constitute a variable-speed transmission installed in the power train between a prime mover (not specifically shown) and the shaft of the carded drum 3. For example, the illustrated adjusting device 84 can constitute a servomotor for a variable speed transmission whose output element drives the drum 3 and/or 4 of the structure shown in FIG. 1. The servomotor can alter the ratio of the transmission so as to increase or reduce the peripheral speed of the drum 3 and/or 4. The arrangement is such that the speed of the conveyor 4 and drum 3 is increased if the signal from the transducer 18 indicates that the mass per unit length of the stream of surplus 51 is reduced, and vice versa. This ensures that the combined quantity of fresh tobacco and returned surplus per unit of time is maintained at a substantially constant value. The length of the discharge end 53 of the vibratory conveyor 52 preferably equals or approximates the width of the shower 16 above the guide wall 36 (as measured at right angles to the plane of FIG. 1) to ensure that the surplus 51 is admitted across the full or nearly full width of the shower.

The peripheral speed of the drum 3 and conveyor 4 is preferably synchronized with that of the conveyor 12 so as to ensure that any adjustments of the speed of the drum 3 and/or conveyor 4 entail automatic adjustments of the speed of the conveyor 12 or vice versa. This simplifies the adjusting means for the feeding device 2 and ensures that the singularizing or loosening action of the unit 14 is always properly related to the rate at which the drum 3 draws a layer of tobacco particles from the lower end of the duct 1.

The metering conveyor 4 can constitute a so-called fluted drum.

The improved apparatus preferably further comprises suitable means (e.g., one or more shift registers) for delaying the signals from the transducer 78 to the servomotor 84 so as to guarantee that successive increments of the surplus 51 are admitted into those increments of the shower 16 whose quantities were adjusted via servomotor 84 in dependency upon the intensity and/or other characteristics of signals generated by the aforementioned increments of the surplus 51. In other words, the quantity of fibrous material in that portion of the shower 16 which is located at a level below the carded conveyor 54 is a function of the quantity of fibrous material in the oncoming increment of the surplus 51 which is being showered by the picker roller 56.

An important advantage of the improved method and apparatus is that the surplus 51 is subjected to negligible or minimal mechanical stressing. Mechanical stressing of the surplus 51 can be reduced still further by omitting the carded conveyor 54 and the picker roller for the material which descends from the vibratory conveyor 52. Absence of pronounced mechanical stressing is due to the fact that the surplus 51 is not admitted into the duct 1 and, therefore, it need not pass through the mechanism including the drum 3, conveyor 4, picker roller 6, drum 12 and picker roller 13.

Another important advantage of the improved method and apparatus is that the mass per unit of time of the combined shower containing fresh fibrous material and the surplus 51 is at least substantially constant which ensures that the quantity of surplus tobacco in the filler 69 is constant.

An additional important advantage of the improved method and apparatus is that the surplus 51 is or can be homogeneously distributed in the shower 16. This can be readily achieved by properly selecting the position and the length of the discharge end 53 of the vibratory conveyor 52. Homogenization of the distribution of surplus 51 in the shower 16 can be enhanced by the provision of singularizing or loosening means including the carded drum 54 and picker roller 56.

The aforediscussed treatment of fresh fibrous material which issues from the duct 1 and of the surplus 51 further ensures that the shower 16 which advances along the guide wall 36 toward the stream building station 40 does not contain any clumps or other undesirable large accumulations of fibrous material. Reliable prevention of the formation and advancement of clumps is achieved with relatively simple means and by utilizing a relatively small distributor.

Still another important advantage of the improved method and apparatus is that singularized particles which form the shower 16 below the loosening unit 14 of FIG. 1 are in an optimum condition for accurate classification so as to ensure complete or nearly complete segregation of lightweight (more satisfactory) constituents from the heavier constituents, normally fragments of tobacco ribs.

Figure 2:
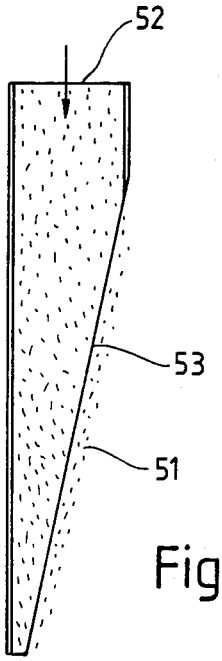
FIG. 2 is a plan view of a vibratory conveyor for delivery of the surplus to the shower of fibrous material which is on its way to the stream building station, the view being taken in the direction of arrow II in FIG. 1.
Figure 4:
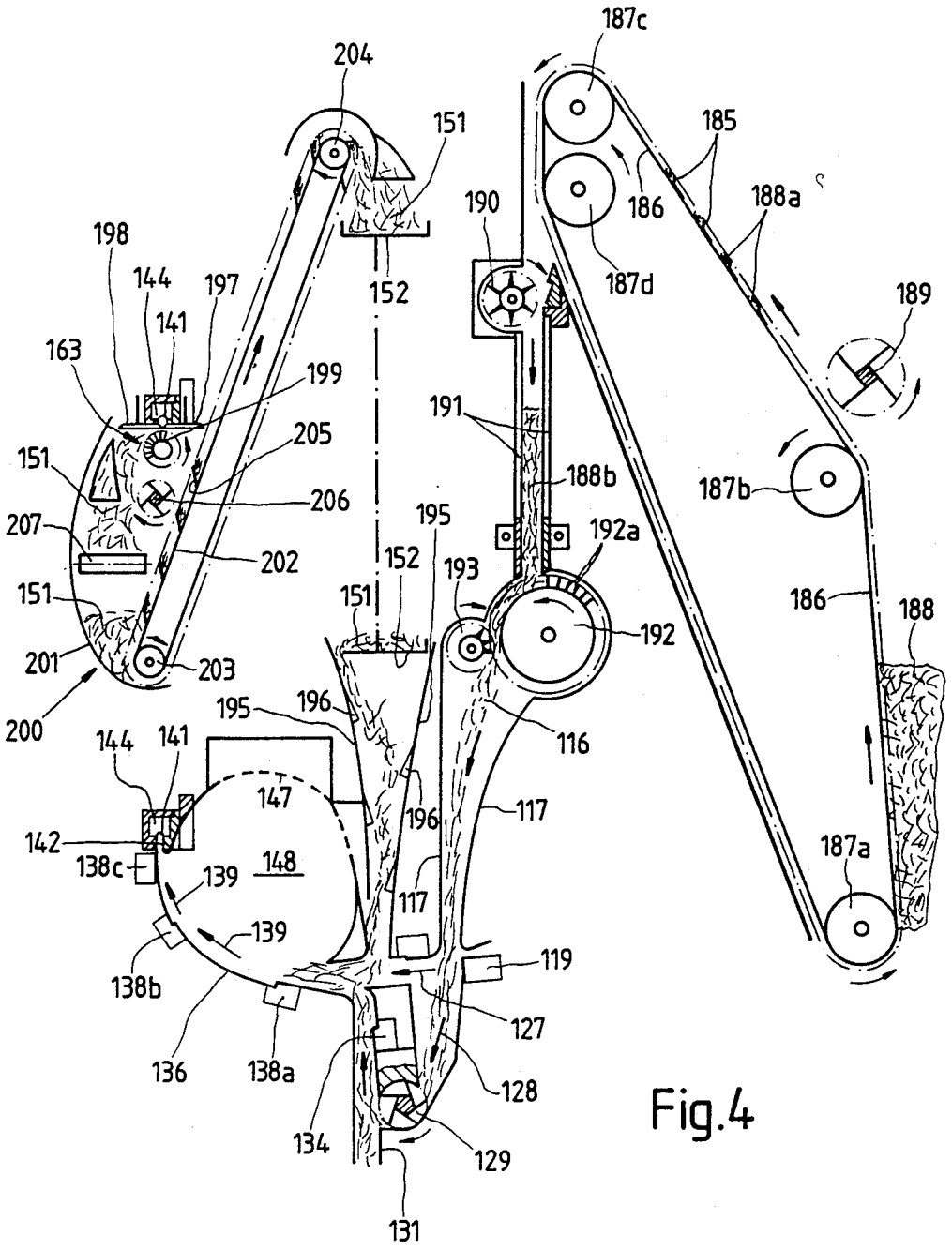
FIG. 4 is a fragmentary partly elevational and partly vertical sectional view of a portion of the distributor in a modified apparatus.

FIG. 4 shows a portion of a modified apparatus wherein all such parts which are identical with or clearly analogous to the corresponding parts of the apparatus of FIGS. 1–3 are denoted by similar reference characters plus 100. The modified apparatus employs different means for delivering a shower of fresh fibrous material to the underside of the lower reach of the stream building conveyor 141, and the means for delivering the surplus 151 to such shower does not employ the carded drum 54 and picker roller 56 of FIG. 1.

The means for supplying fibrous material into a duct 191 (source of supply of fresh fibrous material) comprises an elevator conveyor 186 having a series of equidistant pockets 185 which draw batches **188*a* of fibrous material from a main source or magazine 188 adjacent the ascending reach of the conveyor 186. A paddle wheel 189 is adjacent the path of upward movement of filled pockets 185 to remove the surplus from successive batches 188*a* before the batches are dumped into the duct 191 to form a column 188*b*. The elevator conveyor 186 is trained over several pulleys 187*a*, 187*b*, 187*c* and 187*d*. The pockets 185 can be replaced with forks or with other entraining elements for the batches 188*a*. The means for driving one of the pulleys 187*a*–187*d* is not specifically shown in the drawing. Reference may be had to the aforementioned patent to Steiniger. The upper end of the duct 191 is adjacent a rapidly rotating picker roller 190 which singularizes the fibrous material of the batches 188*a*. The manner in which the upper level of the column 188*b* of fibrous material in the duct 191 is maintained at a substantially constant value is described in the patent to Steiniger as well as in many other U.S. patents of the assignee. The monitoring means for the level of the column 188*b* regulates the speed of the elevator conveyor 186**.

The lower end of the duct 191 is adjacent the uppermost portion of a carded drum 192 whose carding **192*a* receives a layer of fibrous material and delivers successive increments of the layer into the range of a rapidly rotating picker roller 193 which converts the layer into a shower 116 descending in a substantially vertical downwardly tapering funnel-shaped channel 117. The drum 192 and picker roller 193 can be utilized in addition to or in lie of the homogenizing conveyor 4, drum 12 and picker roller 13 of the apparatus which is shown in FIG. 1**.

The manner in which the particles of the shower 116 are classified according to size and/or weight in the lower portion of the apparatus shown in FIG. 4 is analogous to or identical with the manner of classifying as described in connection with FIG. 1. That portion of the shower 116 which reaches the upper side of the guide wall 136 is devoid of the heaviest fragments and advances in the direction indicated by the arrows 139 under the action of jets or streams of air issuing from the sources **138*a* and 138*b* of compressed air. An additional source 138*c* of compressed air (with one or more nozzles, not shown) is closely adjacent the channel 142 at the underside of the stream building conveyor 141. As can be seen in FIG. 4, the lower reach of the conveyor 141** is deformed so that it has a substantially U-shaped cross-sectional outline.

The surplus 151 is delivered by a trough-shaped vibratory conveyor 152 which causes the particles of the surplus to trickle into a downwardly tapering funnel-shaped conduit 195 having internally arranged guide vanes 196 to ensure more uniform distribution of the surplus on its way into the diverted shower 116 approaching the right-hand end of the guide wall 136.

FIG. 4 shows the stream building conveyor 141 twice, once adjacent the channel 142 and once adjacent to an adjustable trimming or equalizing device 163 having two cooperating disc-shaped tobacco clamping elements 197, 198 which engage the stream of tobacco particles at a desired level so that the surplus 151 extends downwardly. Such surplus is separated by a rapidly rotating brush 199 or by a severing tool in a manner known from the art and disclosed in several U.S. patents of the assignee of the present application. The removed surplus 151 descends into the bottom portion of a substantially funnel-shaped magazine 200 which forms part of the means for admitting the surplus into the shower 116. The magazine 200 comprises a fixed wall 201. A portion of the magazine 200 is formed by the ascending reach of an elevator conveyor 202 which is trained over pulleys 203, 204 and serves to deliver batches of surplus into the vibratory conveyor 152 whence the surplus is caused to enter the aforementioned conduit 195. The elevator conveyor 202 has pockets 205 or otherwise configurated entraining means for discrete batches of surplus tobacco. Such batches are equalized by a paddle wheel 206 which can be constructed in the same way as the paddle wheel 189. For example, each paddle wheel can be provided with a set of leather straps which slap against the projecting portions of the batches in the pockets 185 or 205 and return the excess into the source 188 or magazine 200.

The magazine 200 can further receive fibrous material from a belt conveyor 207 which serves to admit the so-called long ends. The long ends constitute fibers of the leading portion of a freshly formed stream (such as the stream 61 of FIG. 3) which advances beyond the trimming station without any removal of the surplus. Such long ends are not draped into cigarette paper. The long ends are mixed with the other surplus 151 in the lower portion of the magazine 200 and are entrained by the oncoming pockets 205 to be introduced into the shower 116 below the conduit 195.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of building a stream of particulate fibrous material, such as fragments of tobacco leaves, comprising the steps of converting a flow of fibrous material into a shower of at least partially singularized particles and admitting the shower into a first portion of a predetermined path so as to build a continuous stream which contains a surplus of fibrous material; advancing the stream along said path and equalizing the stream in a second portion of the path downstream of said first portion, including removing said surplus; monitoring the mass of the removed surplus and generating signals denoting the monitored mass; admitting the removed surplus directly into the flow of fibrous material which forms the shower; and utilizing said signals to regulate the quantity of fibrous material in said flow so as to maintain the combined quantity of fibrous material of said flow and said surplus downstream of the second portion of said path at an at least substantially constant value.

2. The method of claim 1, wherein said converting step includes forming a relatively wide shower of fibrous material and said admitting step includes introducing the surplus into the shower along the major part at least of the width of the shower.

3. The method of claim 1, further comprising the step of at least partially singularizing the fibrous material of said surplus not later than in the course of said admitting step.

4. The method of claim 1, further comprising the steps of establishing and maintaining a source of fibrous material, drawing from the source a continuous layer of fibrous material by the carding of a rotary conveyor, expelling successive increments of the layer from the carding by a rapidly driven picker roller and transforming the expelled increments into a current, and loosening the fibrous material of the current to convert the current into said flow.

5. The method of claim 4, wherein said loosening step includes accelerating the particles of fibrous material in the current by a rapidly driven rotary conveyor.

6. The method of claim 4, wherein said transforming step includes advancing the expelled increments with the carding of a second rotary conveyor at a speed several times the speed of the layer.

7. The method of claim 4, further comprising the step of classifying the particles of the flow according to size including conveying a stream of gaseous fluid transversely of and across the flow so as to divert lighter particles toward the first portion of said path.

8. The method of claim 7, wherein said diverting step includes guiding the lighter particles along a predetermined second path.

9. The method of claim 1, further comprising the step of storing the removed surplus, said admitting step including transferring metered quantities of fibrous material from the stored surplus into said flow.

10. The method of claim 9, wherein said storing step includes accumulating the surplus in a funnel-shaped magazine and said transferring step includes removing surplus from the magazine by means of an elevator conveyor.

11. Apparatus for building a stream of particulate fibrous material, such as fragments of tobacco leaves, comprising a source of supply of fibrous material; an elongated stream forming conveyor defining an elongated path; an adjustable feeding device having means for continuously drawing a flow of fibrous material from said source of supply, for converting the flow into a shower, and for admitting the shower into a first portion of said path so that said conveyor accumulates and advances in a predetermined direction a continuous stream containing a surplus of fibrous material; a trimming device having means for removing the surplus from the stream in a second portion of said path downstream of said first portion; means for admitting the removed surplus to the fibrous material in said feeding device; means for monitoring the mass of the removed surplus and for generating signals denoting the monitored mass; and means for adjusting said feeding device in response to said signals so that the combined quantity of surplus and of fibrous material from the source of supply in the stream downstream of said trimming device is at least substantially constant.

12. The apparatus of claim 11, wherein said feeding device has means for converting the flow into a shower having a predetermined width and said admitting means includes means for delivering the fibrous material of the surplus to the shower along the major portion at least of said predetermined width..

13. The apparatus of claim 11, wherein said admitting means comprises a vibratory conveyor.

14. The apparatus of claim 13, wherein said vibratory conveyor has a discharge end extending at an oblique angle to the direction of advancement of fibrous material along said vibratory conveyor.

15. The apparatus of claim 13, wherein said admitting means further comprises means for showering the surplus intermediate said vibratory conveyor and the shower which is formed by said feeding device.

16. The apparatus of claim 15, wherein said vibratory conveyor has a discharge end above said showering means and said showering means comprises a carded rotary conveyor disposed below said discharge end to accumulate a layer of fibrous material, and a picker roller arranged to expel successive increments of the layer from the carding of said carded conveyor.

17. The apparatus of claim 11, wherein said drawing means comprises a first rotary carded conveyor arranged to remove fibrous material from the source of supply in the form of a continuous first layer at a first speed, a first picker roller arranged to expel successive increments of the first layer from the carding of the carded conveyor at a higher second speed, a second rotary carded conveyor arranged to accumulate the expelled fibrous material into a second layer and to advance the second layer at a speed several times said first speed, and a second picker roller arranged to expel successive increments of the second layer from the carding of said second conveyor and to convert such increments into a shower of fibrous material.

18. The apparatus of claim 17, wherein said source of supply comprises a duct having a discharge end above said first carded conveyor.

19. The apparatus of claim 17, wherein the speed of the second layer on said second carded conveyor is between five and ten times said first speed.

20. The apparatus of claim 17, wherein said source of supply is disposed at a level above said first carded conveyor and said first carded conveyor is disposed at a level above said second carded conveyor.

21. The apparatus of claim 17, wherein the second stream contains lighter and heavier particles of fibrous material and said converting means comprises means for directing at least one current of air across the showered second layer so as to divert lighter particles of fibrous material toward the first portion of said path.

22. The apparatus of claim 21, wherein the heavier particles traverse said current of air and entrain some of the lighter particles and further comprising means for pneumatically segregating the entrained lighter particles and for delivering the segregating lighter particles to the flow of fibrous material not later than in the first portion of said path.

23. The apparatus of claim 11, wherein said admitting means comprises a magazine for the removed surplus and means for supplying fibrous material from said magazine to the flow in said feeding device.

24. The apparatus of claim 23, wherein said supplying means includes an elevator conveyor arranged to draw fibrous material from said magazine.

25. The apparatus of claim 23, wherein said admitting means comprises a conveyor arranged to admit into said magazine fibrous material which constitutes long ends.

* * * * *